US008511133B1

(12) United States Patent
Chen

(10) Patent No.: US 8,511,133 B1
(45) Date of Patent: Aug. 20, 2013

(54) EXPANDER FOR TUBULAR ELEMENTS

(71) Applicant: Jun Fan Chen, Taichung (TW)

(72) Inventor: Jun Fan Chen, Taichung (TW)

( * ) Notice: Subject to any disclaimer, the term of this patent is extended or adjusted under 35 U.S.C. 154(b) by 0 days.

(21) Appl. No.: 13/685,707

(22) Filed: Nov. 27, 2012

(51) Int. Cl.
*B21D 41/02* (2006.01)
*B23P 19/04* (2006.01)

(52) U.S. Cl.
USPC ..... 72/393; 269/43; 269/48.1; 29/263

(58) Field of Classification Search
USPC ..... 72/370.05, 353.4, 391.4, 393; 29/263, 29/265, 280, 523; 269/43, 48.1
See application file for complete search history.

(56) References Cited

U.S. PATENT DOCUMENTS 1,831,003 A * 11/1931 Holland ..... 29/263
2,226,078 A * 12/1940 Spahn ..... 279/2.15
3,077,916 A * 2/1963 Vaughn ..... 72/393
3,986,383 A * 10/1976 Petteys ..... 72/393
4,104,775 A * 8/1978 Lawless ..... 29/265
4,530,231 A * 7/1985 Main ..... 72/393
4,589,180 A * 5/1986 Vachon ..... 29/263
4,685,662 A * 8/1987 Vaughn ..... 269/43
5,074,536 A * 12/1991 McConkey ..... 269/43
5,408,732 A * 4/1995 Anfuso ..... 29/263
8,302,448 B2 * 11/2012 Woelcken et al. ..... 72/370.05

* cited by examiner

*Primary Examiner* — David B Jones

(57) ABSTRACT

An expander includes a first head member, a rotating portion, a plurality of expanding members, and a tightening structure. The first head member and the rotating portion have conical faces corresponding to each other. The rotating portion has a threaded rod section which is screwed with the first head member. The expanding members are arranged around the two conical faces, and the expanding members tend to approach each other due to the tightening structure. When the rotating portion is rotated to approach the first head member, the expanding members are pushed outward to radially expand a tubular element. In addition, a plurality of restriction slots are formed on the conical face of the first head member, and each expanding member forms a corresponding rib slidably disposed in the restriction slot to improve stability.

5 Claims, 4 Drawing Sheets

EXPANDER FOR TUBULAR ELEMENTS

BACKGROUND OF THE INVENTION

1. Field of the Invention

The present invention relates to an expander for radially expand tubular elements.

2. Description of the Prior Art

A conventional expander for tubular elements are disclosed in TWI320459, U.S. Pat. No. 3,077,916, or U.S. Pat. No. 4,530,231. Two conical clamping elements are arranged correspondingly, and a plurality of expanding pieces are arranged around conical faces of the clamping elements. When the distance between the two clamping elements, the expanding pieces are radially pushed outward by the conical faces, and a wall of the tubular element is expanded outward.

Generally, the two clamping elements are screwed with a threaded rod. The two clamping elements approach or move away from each other when the threaded rod is rotated. More specifically, one of the clamping elements rotates with the threaded rod, and another of the clamping elements rotates relative to the threaded rod. That is, the two conical faces rotate relative to each other. However, the expanding pieces abut against the two conical faces, so the expanding piece may possibly expand unevenly when the two conical faces rotate with respect to each other. As a result, the expanding pieces are possible to be damaged.

To prevent the problems mentioned above, the expanding pieces are disposed on one of the clamping elements. By the clamping element fixing, the expanding pieces are prevented from distortion. For instance, the conical face of one of the clamping elements is formed with a plurality of ribs spacedly arranged, or the conical face is formed as a pyramid. The ribs or the edges are located between any two expanding pieces to prevent the expanding pieces from rotating relative to the conical faces. However, the ribs abut against the edges of the expanding pieces, so force is unable to be distributed evenly on the expanding pieces. Also, the edges of the expanding pieces may be abraded. Furthermore, because torque in a fixed direction is exerted on the expanding pieces, the abrasions at two sides of the expanding pieces are uneven. After using for a long time, the shape of each expanding piece is not symmetrical anymore.

Besides, a tool for extracting a tubular element having a similar structure as the expander is disclosed in U.S. Pat. No. 4,104,775. However, the expanding pieces are not fastened together and are possible to fall down. Also, the guiding slots are formed on the inner face of the expanding piece, so the expanding piece has smaller thickness and weak structure strength. To work on tubular elements extraction, the expanding piece standing smaller force is still functional. However, to work on tubular elements expansion, the expanding piece standing larger force may be unfunctional or damaged. If increasing the thickness to improve structure strength, the expanding pieces are difficult to be inserted into smaller tubular elements.

SUMMARY OF THE INVENTION

The main object of the present invention is to provide an expander which has better structure strength and is able to radially expand a tubular element evenly.

To achieve the above and other objects, an expander of the present invention includes a first head member, a rotating portion, a plurality of expanding members, and at least one tightening structure.

The first head member has a first end and an opposite second end. A protruding first conical face is formed at the second end, and external diameters of the first conical face are reduced from the first end to the second end. A first threaded hole is formed on the first head member and extends from the first end to the second end. A plurality of restriction slots are formed on the first conical face and are spacedly arranged around an extending direction of the first threaded hole.

The rotating portion forms a protruding second conical face at an end. A threaded rod section is formed and extends away from the rotating portion from a tip of the second conical face. The threaded rod section is inserted through the first threaded hole and screwed with the first head member in the first threaded hole from the second end of the first head member so that the first conical face and the second conical face each other.

The expanding members are arranged around the threaded rod section and are sandwiched between the first conical face and the second conical face. A first inclined face and a second inclined face are formed on two ends of an inner face of the expanding member respectively. The first inclined face abuts against the first conical face, and the second inclined face abuts against the second conical face so that a face of each expanding member opposite to the threaded rod section is parallel to a longitudinal direction of the threaded rod section. In addition, the first inclined face of each expanding member forms a rib which is slidably disposed in one of the restriction slots so that each expanding member is unable to rotate relative to the first head member.

The tightening structure is disposed on the expanding members so that each expanding member tends to approach the threaded rod section.

In use, when the rotating portion is rotated to reduce a distance between the first head member and the rotating portion, the expanding members are pushed outward by the first conical face and the second conical face to move away from each other. Thus, a tubular element sleeved onto the expanding members is expanded outward by the expanding members so that an internal diameter of the tubular element is increased.

Thereby, the expanding members are prevented from rotating to keep stable due to the ribs and the restriction slots. Also, the expanding members are able to radially expand evenly.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
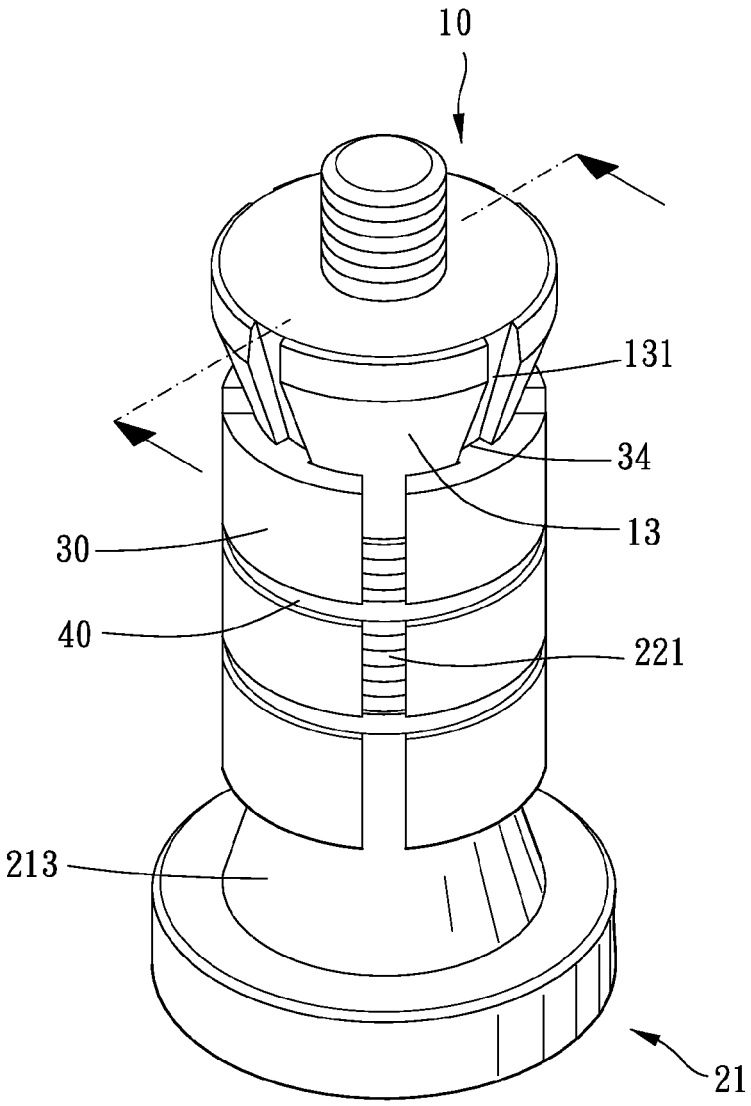
FIG. 1 is a stereogram of the present invention.
Figure 2:
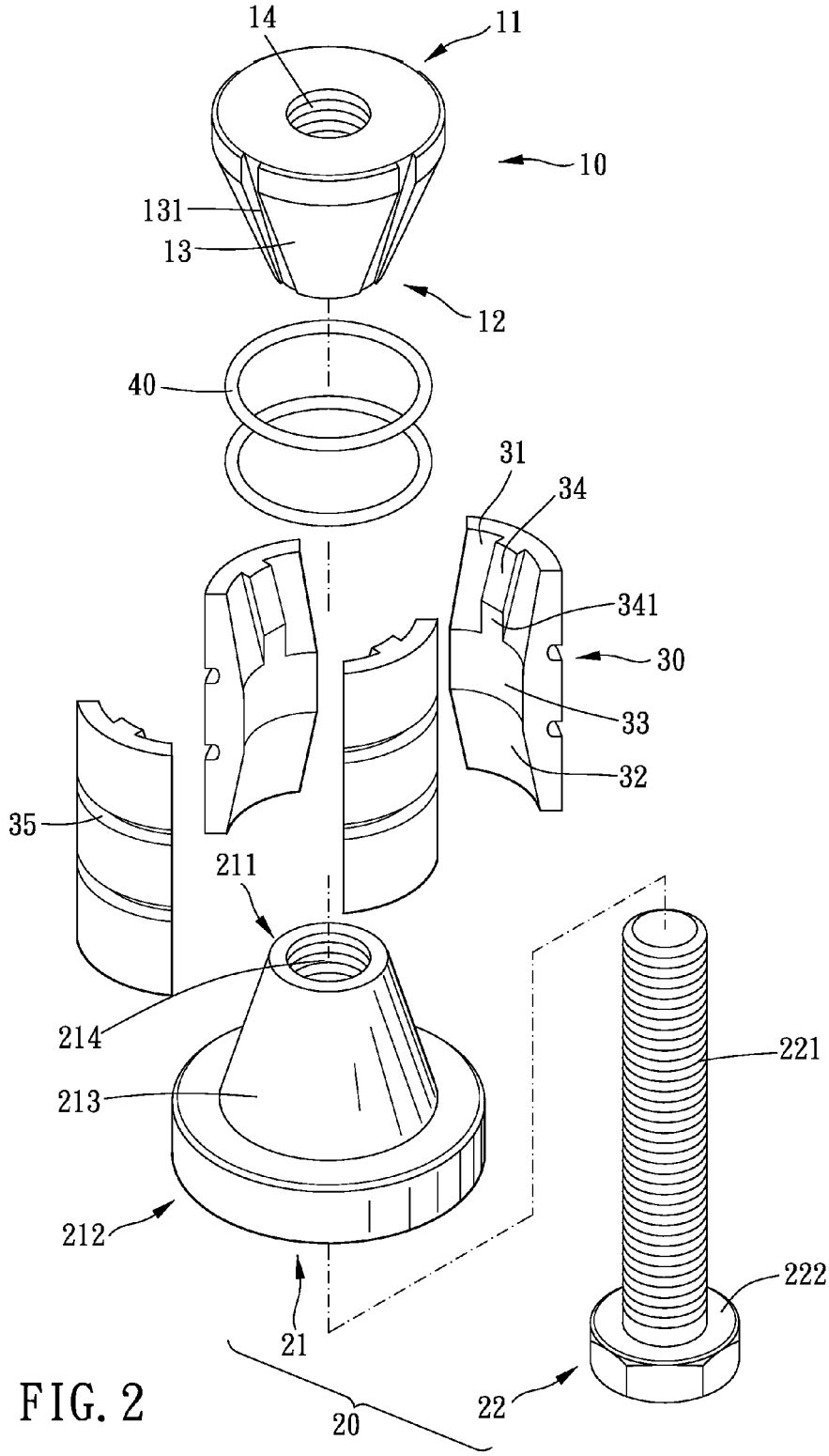
FIG. 2 is a breakdown drawing of the present invention.

Please refer to FIG. 1 to FIG. 3 and FIG. 5. The expander for tubular elements of the present invention includes a first head member 10, a rotating portion 20, a plurality of expanding members 30, and at least one tightening structure.

The first head member 10 has a first end 11 and an opposite second end 12. A protruding first conical face 13 is formed at the second end 12. Preferably, the first conical face 13 is circular cone-shaped. The first conical face 13 has external diameters reduced from the first end 11 to the second end 12. The first head member 10 forms a first threaded hole 14 extending from the first end 11 to the second end 12, and an opening of the first threaded hole 14 is formed at a tip of the first conical face 13. In addition, the first conical face 13 forms a plurality of restriction slots 131. The restriction slots 131 are spacedly arranged around an extending direction of the first threaded hole 14. In other words, each restriction slot 131 extends from a bottom portion to the tip of the first conical face 13.

The rotating portion forms a protruding second conical face at an end. A threaded rod section in a predetermined length is formed and extends from a tip of the second conical face away from the rotating portion. The threaded rod section is inserted through and screwed with the first threaded hole from the second end of the first head member so that the first conical face and the second conical face each other. In the present embodiment, the rotating portion 20 includes a second head member 21 and a fastening element 22. The second head member 21 has a third end 211 and an opposite fourth end 212. The second conical face 213 is formed at the third end 211. Preferably, the second conical face 213 is also circular cone-shaped. The second head member 21 forms a second threaded hole 214 extending from the third end 211 to the fourth end 212, and an opening of the second conical face 213 is formed at a tip of the second conical face 213. The fastening element 22 has the threaded rod section 221 and a blocking portion 222. The threaded rod section 221 is screwed with the second threaded hole 214 and protrudes above the third end 211 of the second head member 211 a predetermined length, and the threaded rod section 221 is further inserted through and screwed with the first threaded hole 14 from the second end 12 of the first head member 10. The blocking portion 222 has a larger external diameter than an internal diameter of the second threaded hole 214 so that the blocking portion 222 abuts against the fourth end 212 of the second head member 21.

The expanding members 30 are arranged around the threaded rod section 221 and are sandwiched between the first conical face 13 and the second conical face 213. A first inclined face 31 and a second inclined face 32 are formed on two opposite ends of an inner face of each expanding member 30 respectively. The first inclined face 31 abuts against the first conical face 13, and the second inclined face 32 abuts against the second conical face 213 so that a face of each expanding member 30 opposite to the threaded rod section 221 is parallel to a longitudinal direction of the threaded rod section 221. In addition, each expanding member 30 forms a rib 34 on the first inclined face 31. Each rib 34 is slidably disposed in one of the restriction slots 131 so that each expanding member 30 is unable to rotate relative to the first head member 10. The tightening structure is disposed to the expanding members 30 so that the expanding members 30 tend to approach the threaded rod section 221. In the present embodiment, the expanding members 30 is circular column-shaped when connected with each other. A face of each expanding member 30 opposite to the threaded rod section 221 forms at least one groove 35. An extending direction of the groove 35 is perpendicular to the longitudinal direction of the threaded rod section 221. Preferably, the grooves 35 positionally correspond to each other and extend around the expanding members 30. The tightening structure includes at least one resilient tightening ring 40. The tightening ring 40 is sleeved onto the expanding members 30 and is received in the grooves 35 so that the expanding members 30 tend to approach each other. Thus, the expanding members 30 are prevented from detachment or uneven arrangement. On the other hand, a mediate face 33 is formed between the first inclined face 31 and the second inclined face 32 of each expanding member 30. The mediate face 33 is parallel to the face of the expanding member 30 opposite to the threaded rod section 221. The rib 34 extends toward the second inclined face 32 to a predetermined position on the first inclined face 31. A connecting portion 341 is formed between the mediate face 33 and the rib 34. The connecting portion 341 and the mediate face 33 are located on a same plane and are not parallel to a top of the rib 34. Besides, a longitudinal axis is defined by a longitudinal direction of the threaded rod section 221. A summation of lengths of the first conical face 13 and the second conical face 213 along the longitudinal axis is larger than a length of each expanding member 30 along the longitudinal axis. Thereby, the first head member 10 and the second head member 21 approach each other to abut against each other, the expanding members 30 are unable to further move outward. Thus, the expanding members 30 are prevented from pushed too much and inclining. The expanding members 30 can be kept stable and parallel, and the tubular element can be radially expanded evenly.

Figure 3:
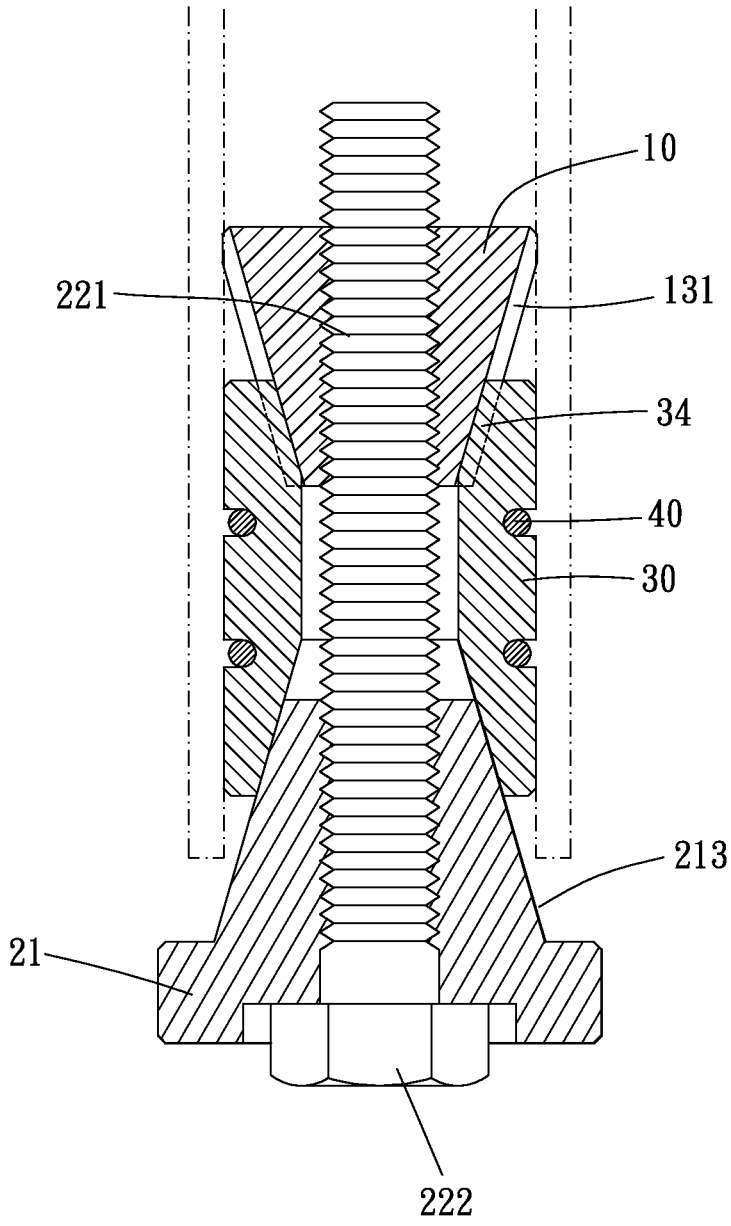
FIG. 3 is a profile of the present invention.
Figure 4:
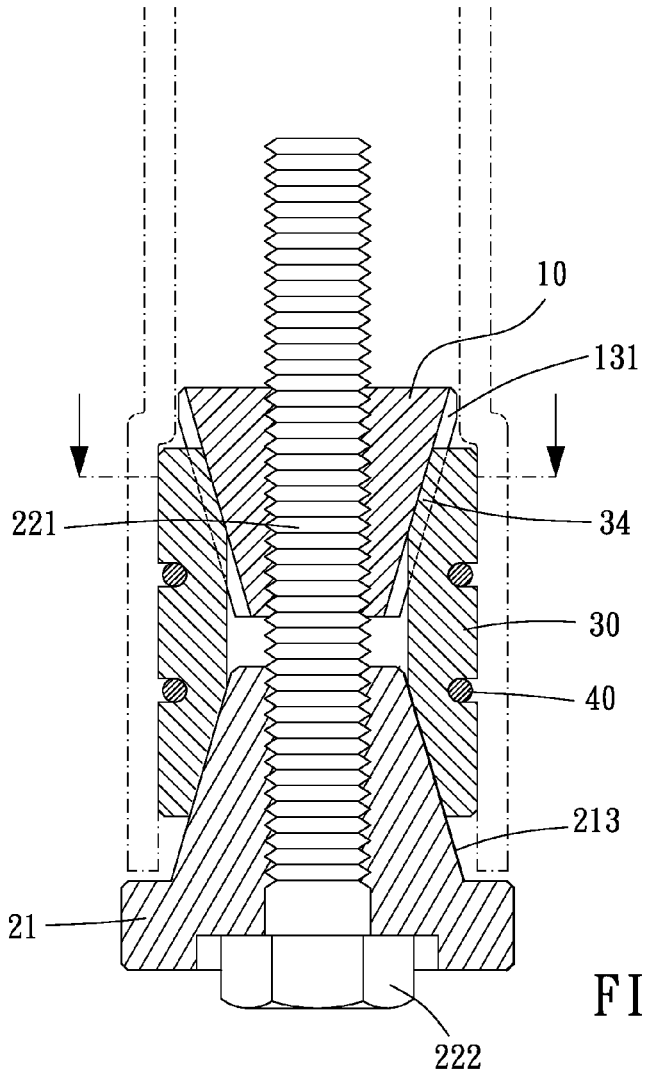
FIGS. 4 and 5 are illustrations of the present invention.
Figure 5:
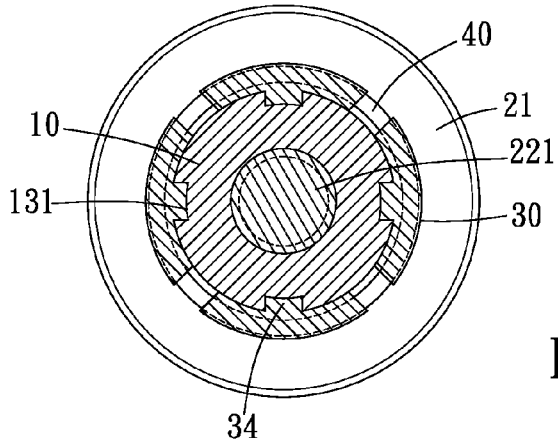

Please refer to FIGS. 3 and 4. In use, the expanding members 30 are placed at a position to be expanded in a tubular element. When the rotating portion is rotated to reduce a distance between the first head member 10 and the rotating portion, the expanding members 30 are pushed away from the threaded rod section 221 by the first conical face and the second conical face to move away from each other. That is, the expanding members 30 are radially moved outward to further push a wall of the tubular element. Thus, the wall of the tubular element are pushed outward and deformed to be expanded. After expanding, the rotating portion can be rotated reversely so that the first head member 10 and the second head member 21 are moved away from each other. Thus, the expanding members 30 approach each other again due to the tightening ring 40. An overall external diameter of the expanding members 30 is reduced, and the expander is able to be removed from the tubular element.

To work on tubular elements in various diameters, expanding members in different curvature diameters or different thicknesses can be utilized. Even more, different expanding members may be used in different stages of expanding. More importantly, the ribs abut against intermediate sections of the expanding members instead of side periphery of each expanding member. Thus, the expanding members are positioned well and are prevented from distortion. Thereby, durability and strength are both promoted.

What is claimed is:

1. An expander for tubular elements, comprising:

a first head member, having a first end and an opposite second end, a protruding first conical face being formed at the second end, external diameters of the first conical faces are reduced from the first end to the second end, a first threaded hole being formed on the first head member and extending from the first end to the second end, a plurality of restriction slots being formed on the first conical face, the restriction slots being spacedly arranged on the first conical face around an extending direction of the first threaded hole;

a rotating portion, a protruding second conical face being formed at an end of the rotating portion, a threaded rod section in a predetermined length being formed and extends away from the rotating portion from a tip of the second conical face, the threaded rod section being inserted through the first threaded hole from the second end of the first head member, the first head member being screwed with the threaded rod with the first threaded hole so that the first conical face and the second conical face face each other;

a plurality of expanding members, being arranged around the threaded rod section and being sandwiched between the first conical face and the second conical face, a first inclined face and a second inclined face being formed on two ends of an inner face of each expanding member respectively, the first inclined face abutting against the first conical face, the second inclined face abutting against the second conical face so that a face of each expanding member opposite to the threaded rod section is parallel to a longitudinal direction of the threaded rod section, a rib being formed on the first inclined face of each expanding member, the rib being slidably disposed in one of the restriction slots so that each expanding member is unable to rotate relative to the first head member;

at least one tightening structure, disposed on the expanding members so that the expanding members tend to approach the threaded rod section;

wherein when the rotating portion is rotated to reduce a distance between the first head member and the rotating portion, the expanding members are pushed outward by the first conical face and the second conical face to move away from each other;

wherein the longitudinal direction of the threaded rod section defines a longitudinal axis, a summation of lengths of the first conical face and the second conical faces along the longitudinal axis is larger than a length of each expanding member along the longitudinal axis.

2. The expander for tubular elements of claim 1, wherein a mediate face is formed on each expanding member between the first inclined face and the second inclined face, the mediate face is parallel to the face of the expanding member opposite to the threaded rod section, the rib extends toward the second inclined face to a predetermined position on the first inclined face, a connecting portion connects the mediate face and the rib, the connecting portion and the mediate face are located on a same plane and are not parallel to a top face of the rib.

3. The expander for tubular elements of claim 1, wherein the rotating portion includes a second head member and a fastening element, the second head member has a third end and an opposite fourth end, the second conical face is formed at the third end, a second threaded hole is formed on the second head member and extends from the third end to the fourth end, the fastening element has the threaded rod section and a blocking portion, the threaded rod section is screwed with the second head member in the second threaded hole and protrudes above the third end of the second head member in a predetermined length, the blocking portion has a larger external diameter than an internal diameter of the second threaded hole so that the blocking portion abuts against the fourth end of the second head member.

4. The expander for tubular elements of claim 1, wherein the first conical face and the second conical face are circular cone-shaped respectively, the expanding members are circular column-shaped when connected together.

5. The expander for tubular elements of claim 1, wherein the face of each expanding member opposite to the threaded rod section is formed with at least one groove, an extending direction of the groove is perpendicular to the longitudinal direction of the threaded rod section, the tightening structure includes at least one resilient tightening ring which is sleeved onto the expanding members and is received in the grooves.

* * * * *